United States Patent [19]

Craft

[11] 4,324,026

[45] Apr. 13, 1982

[54] CREMATION URN WITH READILY ACCESSIBLE MEMORABILIA COMPARTMENT

[75] Inventor: William K. Craft, Cincinnati, Ohio

[73] Assignee: Batesville Casket Company, Inc., Batesville, Ind.

[21] Appl. No.: 232,200

[22] Filed: Feb. 6, 1981

[51] Int. Cl.[3] ..... A61G 17/00

[52] U.S. Cl. ..... 27/1

[58] Field of Search ..... 27/1

[56] References Cited

U.S. PATENT DOCUMENTS

| | | | |
|---|---|---|---|
| 2,009,724 | 7/1935 | Bircher | 27/1 |
| 3,167,844 | 2/1965 | Bachofner | 27/1 |
| 4,199,848 | 4/1980 | Kohnert | 27/1 |

*Primary Examiner*—John D. Yasko

*Attorney, Agent, or Firm*—Burns, Doane, Swecker & Mathis

[57] ABSTRACT

A cremation urn comprises a base section which forms therein a memorabilia chamber sized to contain objects of memorabilia. A drawer is horizontally slidable in the memorabilia chamber and includes an end wall for closing the memorabilia chamber and concealing it from view. An upper tongue of the base section forms a male connector which is received in a female connector of a receptacle section. The latter forms a remains chamber sized to receive the cremated remains of a deceased, the remains chamber being open at its bottom. Threaded fasteners extend upwardly through the base section and into the receptacle section to secure those sections together.

14 Claims, 5 Drawing Figures

CREMATION URN WITH READILY ACCESSIBLE MEMORABILIA COMPARTMENT

BACKGROUND AND OBJECTS OF THE INVENTION

The present invention relates to cremation urns.

Cremation urns traditionally have comprised a decorative body containing a chamber for housing the cremated remains of a deceased. Exemplary of such urns are those described in Bircher U.S. Pat. No. 2,009,724 issued July 30, 1935; Bachofner U.S. Pat. No. 3,167,844 issued Feb. 2, 1965; Kohnert U.S. Pat. No. 4,199,848 issued Apr. 29, 1980; and U.S. Pat. No. Des. 85,087 issued to Clark on Sept. 15, 1931.

The urn is typically provided with a closure which can be placed over the chamber and fastened shut once the remains have been introduced. The chamber is usually of a size sufficient to contain small objects of memorabilia, including a memorial scroll commemorating the deceased. Viewing of this memorabilia, however, requires that the chamber be opened and the remains disturbed.

It is, therefore, an object of the present invention to provide a novel cremation urn.

It is another object of the present invention to enable access to the memorabilia in a cremation urn to be gained without disturbing the remains.

A further object is to enable memorabilia to be accessible while maintaining the decorative appearance of the urn.

SUMMARY OF THE INVENTION

These objects are achieved by the present invention which involves a cremation urn comprising a decorative housing forming therein a first internal chamber for receiving the cremated remains of a deceased. The first chamber can be closed and concealed from view. The housing forms therein a second internal chamber separate from the first chamber and sized to receive objects of memorabilia. A manually openable member is provided for closing the second chamber and concealing it from view.

Preferably, the manually openable member comprises a slidable drawer.

Preferably, the housing comprises a receptacle section and a base section. The receptacle section forms the first chamber, and the base section forms the second chamber. The receptacle section forms a female connector which receives a male connector formed by the base section. Fasteners extend upwardly through the base section to secure the sections together.

THE DRAWINGS

These objects and advantages of the invention will become apparent from the following detailed description of a preferred embodiment thereof in connection with the accompanying drawings in which like numerals designate like elements, and in which.

DETAILED DESCRIPTION OF A PREFERRED EMBODIMENT OF THE INVENTION

Figure 1:
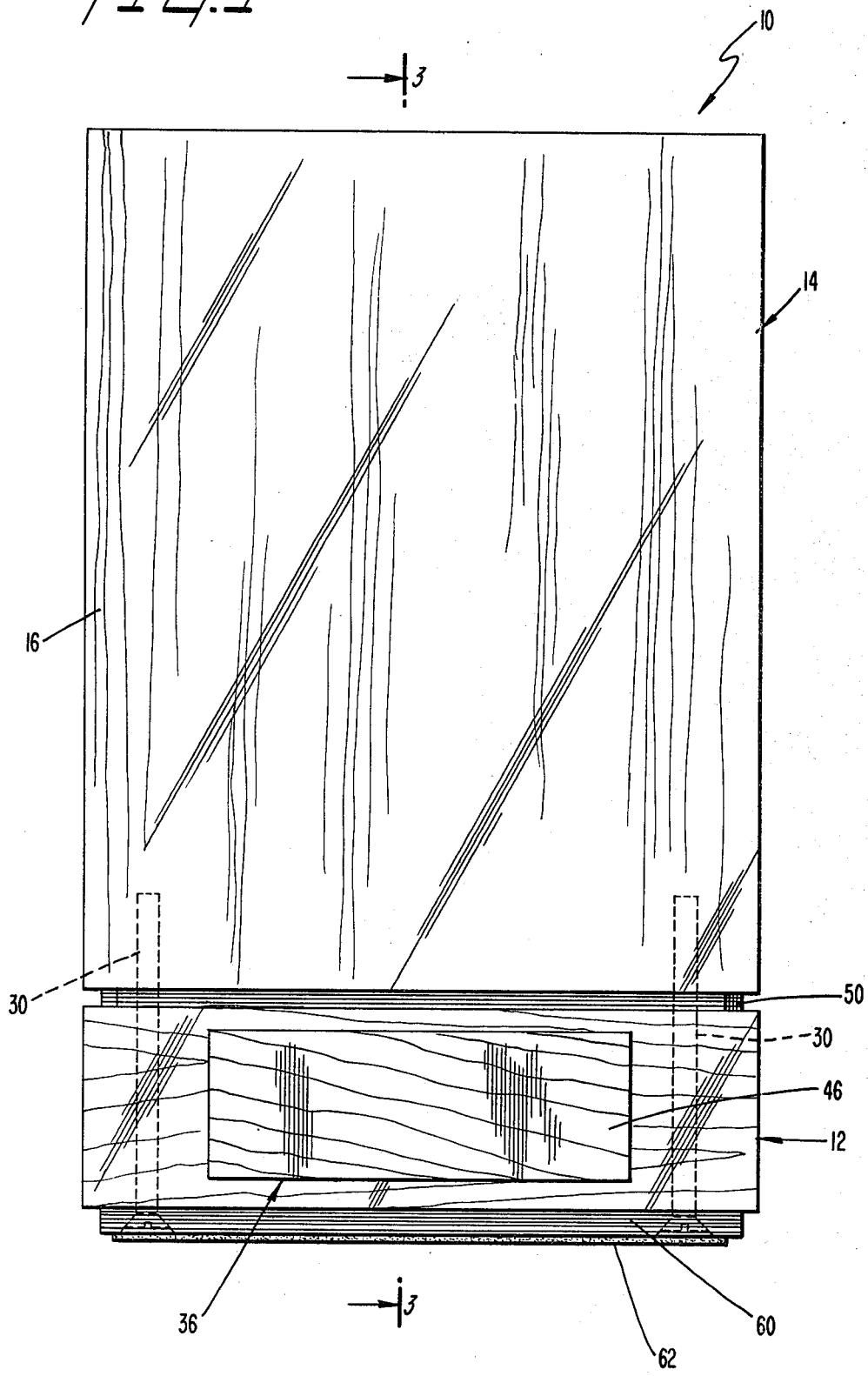
FIG. 1 is a front elevational view of a cremation urn according to the present invention.

A cremation urn 10 according to the present invention comprises a base section 12 and a receptacle section 14 mounted thereon. The receptacle section comprises four upright side walls 16 and a top wall 18 which form an internal chamber 20. The chamber 20, which is open at its bottom, is sized to contain the cremated remains of a deceased.

The side walls 16 include a ridge 21 extending into the chamber 20 which forms a downwardly facing abutment surface 22 at a lower portion 24 of the receptacle section. As will be explained hereinafter, the lower portion 24 forms a female connector which receives a male connector 26 of the base section 12.

Figure 5:
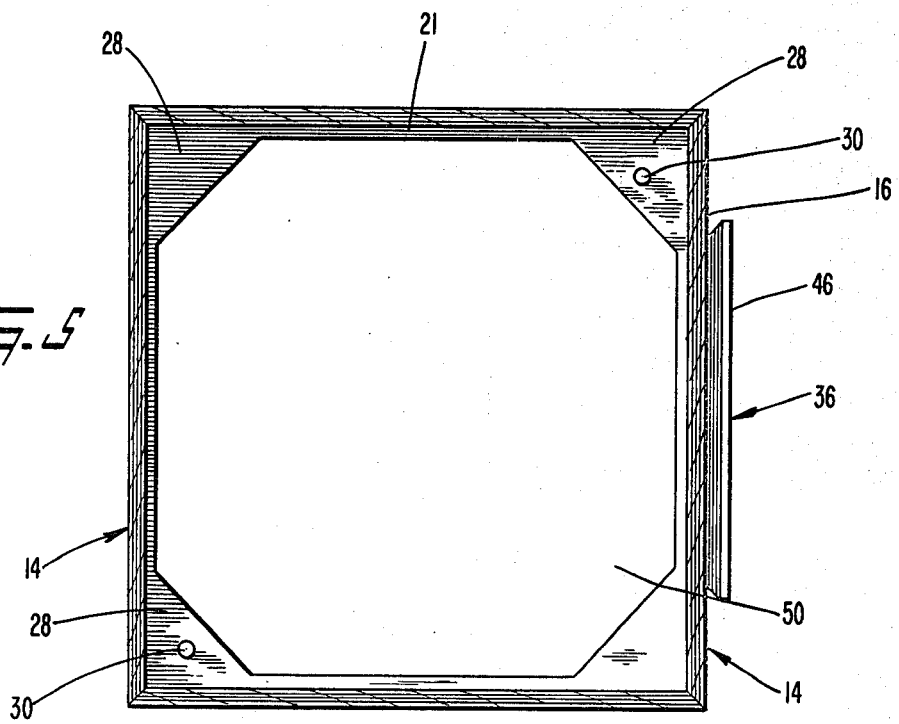
FIG. 5 is a cross-sectional view taken along line 5—5 in FIG. 2.

The ridges 21 are somewhat enlarged at the corners 28 (FIG. 5) to receive threaded fasteners 30 which project upwardly from the base section 12 as will become apparent.

The base section 12 includes four upright side walls 32 and the four-sided male connector 26 previously mentioned, the latter projecting upwardly. Formed within the base section is a memorabilia chamber 34 sized to contain objects of memorabilia such as a memorial scroll, jewelry, etc., associated with the deceased.

The memorabilia chamber is open at a front one of the side walls 32 and receives a drawer 36 for horizontal sliding movement. The drawer 36 includes four upright side panels 38, front and rear end panels 40, 42, and a floor 44. The memorabilia are placed within and removed from the drawer by merely sliding-out the drawer.

To this end, a plate 46 may be fastened to the front end panel 40 of the drawer, by screws or the like, to form a grip by which the drawer can be manually pulled. This plate 46, which is non-transparent, is also suitable for having the name of the deceased, or other indicia, inscribed thereon for display.

When the drawer is closed, the memorabilia chamber is covered and concealed from view so as not to disturb the decorative appearance of the urn. In lieu of providing a drawer, a side wall of the base section could be provided with a non-transparent door which covers and conceals the memorabilia compartment 34 within which the memorabilia is stored.

Figure 3:
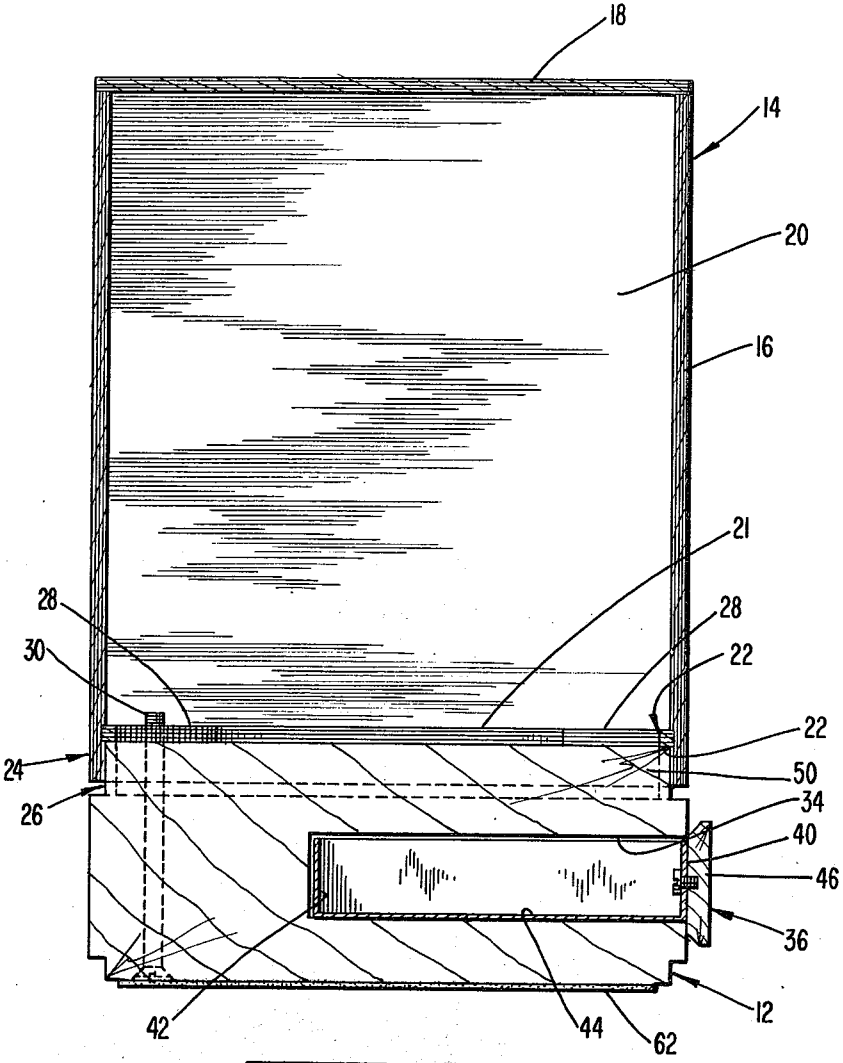
FIG. 3 is a vertical sectional view taken along line 3—3 in FIG. 1.
Figure 2:
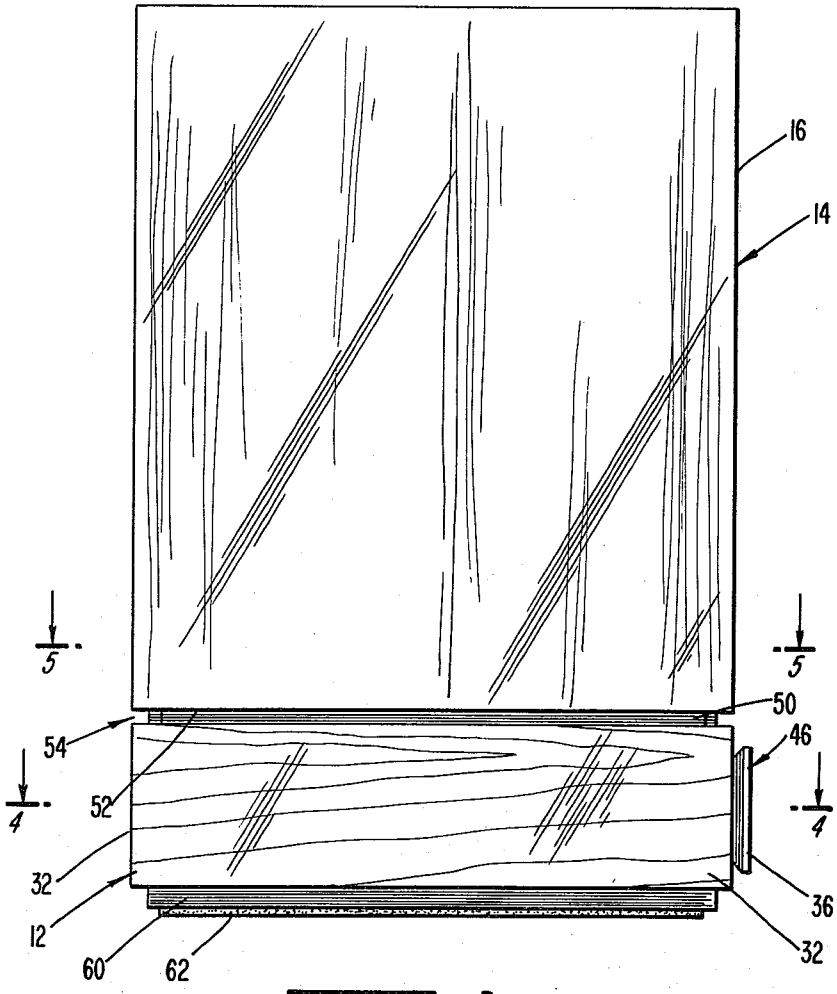
FIG. 2 is a side elevational view of the urn.
Figure 4:
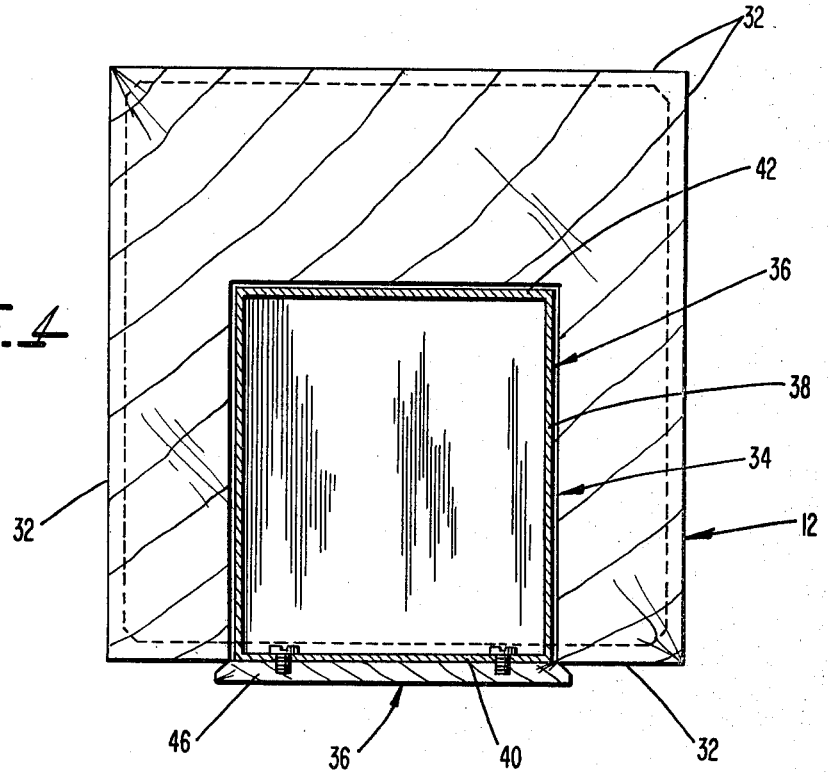
FIG. 4 is a cross-sectional view taken along line 4—4 in FIG. 2.

The male connector 26 of the base comprises an upstanding block 50 or tongue whose side walls are parallel to and slightly offset inwardly from the side walls 32 of the base. In this regard, the dimensions of the opening defined by the side walls 16 of the receptacle section are such as to receive the block 50, possibly with a snug fit. The abutment surface 22 of the receptacle section rests upon the top of the block 50 as depicted in FIG. 3, to space the lower edges 52 of the side walls 16 of the receptacle section vertically above and in alignment with the side walls 32 of the base section (FIG. 2). This vertical spacing 54 assures that positive engagement between the abutment surface 22 and the block 50 occurs.

A lower portion of the base section 12 includes a pedestal portion 60 onto which can be secured a felt pad 62.

The afore-mentioned fastener screws 30 project upwardly through passages in the base section at corners thereof and are threadably received in the enlarged corners 28 of the ridge 21 in the receptacle section 14. Thus, the base and receptacle sections are releasably secured together by the screws 30.

It will be appreciated that the shape of the urn may assume various characteristics in lieu of the rectangular shape depicted, and that any suitable type of materials can be employed for fabrication of the urn.

The urn is utilized by releasing the fastener screws 30 and separating the base and receptacle sections 12, 14. With the receptacle section in an inverted condition from that shown, i.e., with the remains chamber 20 opening upwardly, the cremated remains of the deceased are introduced into the remains chamber 20. The base section is then mounted downwardly onto the receptacle section such that the male and female connectors 24, 26 are mated, i.e., the block 50 extends into the receptacle section 14 and abuts the abutment surface 22, thereby closing-off the remains chamber. In this condition, the fastening screws 30 are inserted downwardly into and through the base section 12 and are fastened to the receptacle section 14 to secure the sections together.

The urn is then returned to the depicted upright position and objects of memorabilia are placed into the memorabilia chamber 34 via the drawer 36.

The cremated remains lie safely reposed within the remains chamber 34, excape therefrom being effectively blocked by the interface between the abutment surface 22 and the block 50 of the base section. If desired, a gasket could be positioned at such interface to enhance the sealing action.

It will be appreciated that disturbance of the remains no longer occurs when access to the memorabilia is desired, because such access is gained mereby by removal of the drawer 36 which is separate from the remains chamber. Removal of the drawer is simplified, there being no fasteners to release.

The remains are safely housed since escape thereof from the remains chamber is blocked by engagement between the block and abutment shoulder. Also, the decorative nature of the urn is not adversely affected by the visibility of fasteners or the like since the latter are concealed beneath the base.

Although the invention has been described in connection with a preferred embodiment thereof, it will be appreciated by those skilled in the art, that additions, modifications, deletions, and substitutions not specifically described, may be made without departing from the spirit and scope of the invention as defined in the appended claims.

What is claimed is:

1. A cremation urn comprising a decorative housing forming therein a first internal chamber for receiving the cremated remains of a deceased, and means for closing said first chamber and concealing it from view, said housing forming therein a second internal chamber separate from said first chamber and sized to receive objects of memorabilia, and manually openable means for closing said second chamber and concealing it from view.

2. An urn according to claim 1, wherein said manually openable means for closing and concealing said second chamber comprises a drawer slidable within said second compartment and sized to contain said objects of memorabilia.

3. An urn according to claim 2, wherein said drawer is horizontally slidable and open at its top.

4. An urn according to claim 1, wherein said housing comprises a receptacle section and a base section removably interconnected, said receptacle section forming said first chamber and being removably mountable atop said base section, said second chamber and manually openable means disposed in said base section.

5. An urn according to claim 4, wherein said first chamber opens from the bottom.

6. An urn according to claim 5, wherein said receptacle section is open at its bottom, said means for closing said first chamber comprising an upper portion of said base section which underlies said first chamber.

7. An urn according to claim 6 including threaded fasteners passing upwardly through said base section and into said receptacle section to interconnect said sections.

8. An urn according to claim 4, wherein said means for closing said second chamber is situated on a vertical side of said base section.

9. An urn according to claim 4, wherein said base section includes an upwardly projecting tongue, said receptacle portion fitting downwardly around said tongue.

10. An urn according to claim 9, wherein said receptacle section includes an abutment surface which contacts said tongue to maintain a lower end of said receptacle section spaced slightly above a side portion of said base section.

11. A cremation urn comprising:

a base section having upright sides and forming therein a memorabilia chamber sized to contain objects of memorabilia, means at a side for closing said memorabilia chamber and concealing it from view, a receptacle section having upright sides and a top and forming therein a remains chamber sized to receive the cremated remains of a deceased, said remains chamber opening from its bottom, said receptacle section being mounted onto said base section, and fastening means for securing said base and receptacle sections together.

12. A cremation urn comprising:

a base section having four upright side walls, a top, and a bottom, said base section forming therein a memorabilia chamber sized to contain objects of memorabilia, a drawer horizontally slidable in said memorabilia chamber and including an end wall for closing said memorabilia chamber and concealing it from view, an upper tongue of said base section being recessed inwardly relative to said side walls and forming a male connector, a receptacle section having four upright side walls, and a top wall and forming therein a remains chamber sized to receive the cremated remains of a deceased, said remains chamber being open at its bottom, a lower portion of said receptacle section forming a female connector which fits over said male connector so that said remains chamber is closed by said base section and said side walls of said receptacle section lie vertically aligned with and slightly above said side walls of said base section, and threaded fasteners extending upwardly through said base section and into said receptacle section to secure said sections together.

13. A cremation urn comprising:

a base having a male connector at its upper end, a receptacle section forming a remains chamber therein sized to receive the cremated remains of a deceased, said remains chamber opening from the bottom, said receptacle section forming a female connector on a lower end thereof which receives said male connector to mount said receptacle section upon said base section, and fasteners extending upwardly through said base section from therebeneath and into said receptacle section to secure said sections together.

14. An urn according to claim 13, wherein said male connector comprises an upstanding tongue on said base, enters said remains chamber and engages a shoulder therein to close-off said remains chamber.

* * * * *